166-308 SR
1/23/79 XR 4,135,579

United States Patent [19]
Rowland et al.
[11] 4,135,579
[45] Jan. 23, 1979

[54] IN SITU PROCESSING OF ORGANIC ORE BODIES

[75] Inventors: Howard J. Rowland, Newton; Joseph T. deBettencourt, West Newton, both of Mass.

[73] Assignee: Raytheon Company, Lexington, Mass.

[21] Appl. No.: 838,265

[22] Filed: Sep. 30, 1977

Related U.S. Application Data

[62] Division of Ser. No. 682,698, May 3, 1976, abandoned.

[51] Int. Cl.[2] ..... E21B 43/24; E21B 43/26

[52] U.S. Cl. ..... 166/248; 166/308; 208/11 R

[58] Field of Search ..... 166/248, 271, 272, 302, 166/308, 60; 219/10.41, 10.65, 10.81; 208/11 R

[56] References Cited

U.S. PATENT DOCUMENTS

| | | | |
|---|---|---|---|
| 2,685,930 | 8/1954 | Albaugh | 166/248 UX |
| 2,757,738 | 8/1956 | Ritchey | 166/248 |
| 3,133,592 | 5/1964 | Tomberlin | 166/60 |
| 3,208,674 | 9/1965 | Bailey | 166/248 X |
| 3,428,125 | 2/1969 | Parker | 166/248 |
| 3,578,080 | 5/1971 | Closmann | 166/248 |
| 3,718,186 | 2/1973 | Brandon | 166/248 |
| 3,948,319 | 4/1976 | Pritchett | 166/248 |
| 3,989,107 | 11/1976 | Fisher et al. | 166/248 |

FOREIGN PATENT DOCUMENTS

| | | | |
|---|---|---|---|
| 2427031 | 12/1975 | Fed. Rep. of Germany | 166/248 |

*Primary Examiner*—Stephen J. Novosad
*Assistant Examiner*—George A. Suchfield
*Attorney, Agent, or Firm*—M. D. Bartlett; J. D. Pannone; H. W. Arnold

[57] ABSTRACT

A method and apparatus for fracturing and/or heating subsurface formations wherein an alternating current electric field is produced in the frequency range between 100 kilohertz and 100 meghertz between electrodes spaced apart in the formation and a radio frequency generator supplying a voltage between said lines with suitable loading structures tuned to the frequency of the generator to resonate the electrodes as a parallel wire transmission line which is terminated in an open circuit and produces a standing wave having a voltage node at the end of the line.

10 Claims, 5 Drawing Figures

FIG. 1
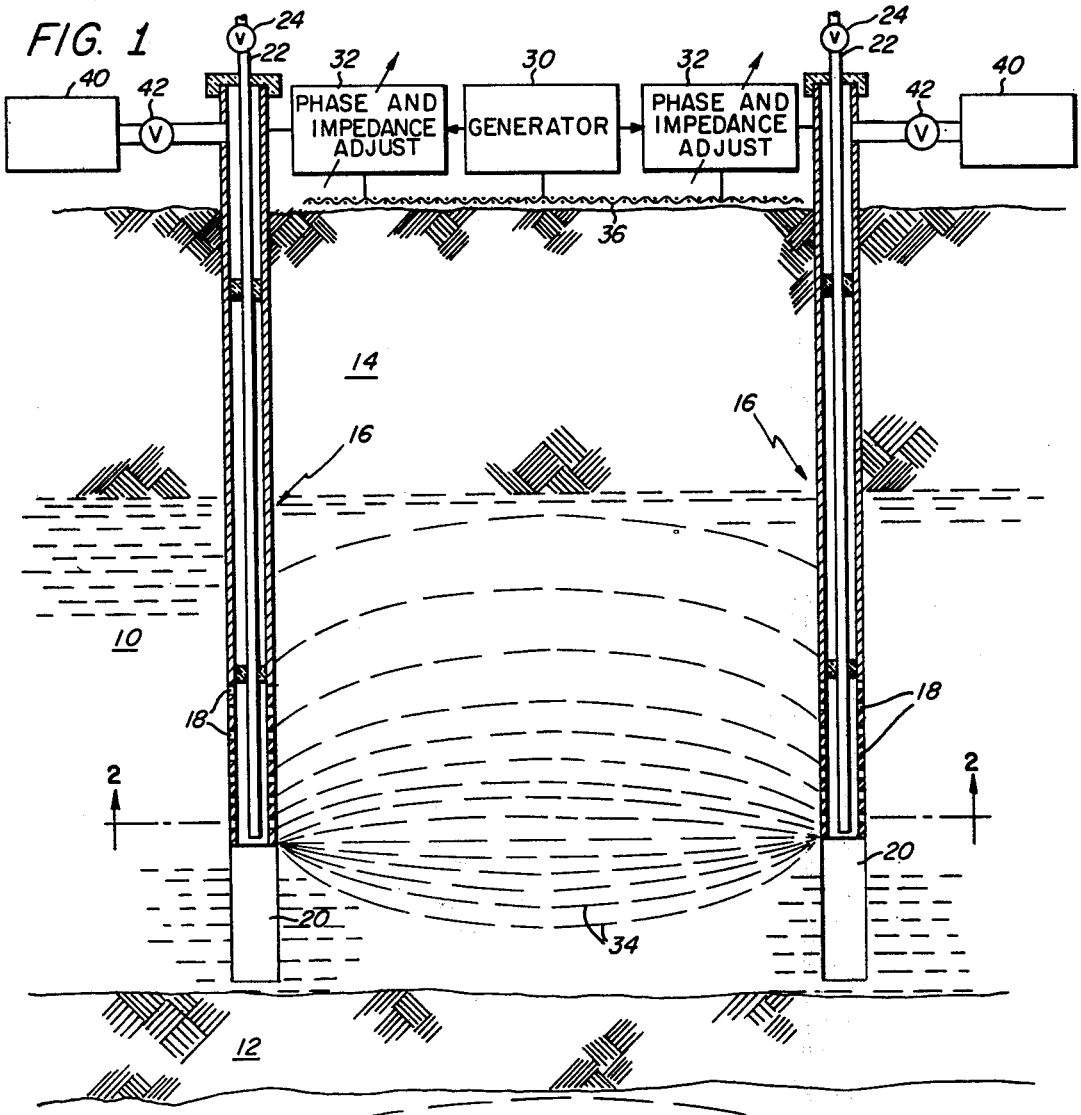
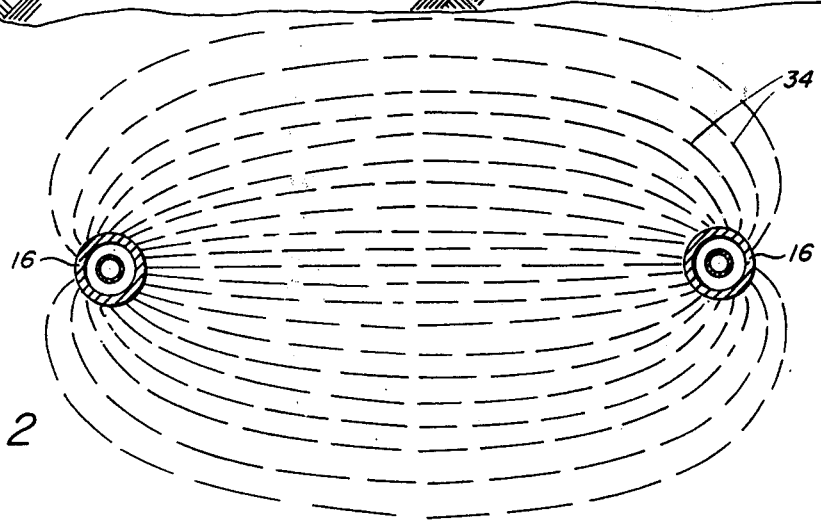
FIG. 2

IN SITU PROCESSING OF ORGANIC ORE BODIES

CROSS-REFERENCE TO RELATED APPLICATIONS

This is a division of application Ser. No. 682,698, filed May 3, 1976 now abandoned.

BACKGROUND OF THE INVENTION

The production of organic products in situ by heating and/or fracturing subsurface formations containing hydrocarbons, such as oil shale or coal beneath overburdens, is desirable but has generally been uneconomical since large amounts of energy are required for fracturing or heating the formation, for example, by injection of heated fluids, by subsurface combustion in the presence of an injected oxidizer, or by nuclear explosion. In the alternative, it has been either necessary to mine the oil shale or coal and convert it to the desired products such as pipe lineable oil or gas or other products on the surface resulting in substantial quantities of residue, particularly in the case of oil shale where the spent oil shale has a larger volume than the original oil shale. In addition, if the kerogen in the oil shale is overheated, the components may not flow or may decompose to undesirable products such as carbonized oil shale which will not flow through fractures formed in the oil shale. In addition, at temperatures above 1000° F., water locked in the shale will be released and the shale can decompose absorbing large amounts of heat and thus wasting input heating energy.

SUMMARY OF THE INVENTION

In accordance with this invention, alternating current electric fields are used to differentially heat a body containing hydrocarbon compounds so that substantial temperature gradients are produced in the body to produce high stresses in the body, such stresses producing conditions which readily fracture the body.

In accordance with this invention, fracturing, which is dependent on temperature gradient, is produced at temperatures substantially below temperatures at which rapid decomposition of the kerogen occurs. More specifically, two electrodes such as eight-inch pipes, extending as a parallel wire line from the surface through an overburden into an oil shale body, have alternating current power supplied to the surface end of the line at a frequency for which the spacing between the electrodes is less than a tenth of a wavelength in the body of oil shale. The length of the electrode from the surface is on the order of a quarter of a wavelength, or greater, of said frequency so that an electric field gradient is produced which is highest at the open circuited end of the line in the oil shale on the surfaces of the portions of the electrodes facing each other. Since heating of the kerogen in the oil shale body is a function of the square of the electric field, the rate of heating is most intense in these regions, producing a substantial thermal gradient between such regions and regions adjacent thereto, with the differential thermal expansion produced by such gradient producing stresses which fracture the formation in said regions.

This invention further provides that fluids may be injected into the formation to assist in the fracturing.

This invention further provides that following fracturing, the formation may be further heated by electric fields between the electrodes at the same and/or different frequency and/or electric field gradients.

This invention further provides that frequencies may be used in which a plurality of voltage nodes appear on the transmission line.

This invention further discloses embodiments of the invention wherein more than two electrodes are supplied with an electric field to reduce the intensity of the electric field gradient during the heating cycle adjacent the electrodes thereby more evenly heating the bulk of the shale oil subsequent to fracturing.

BRIEF DESCRIPTION OF THE DRAWINGS

Other and further objects and advantages of the invention will become apparent as the description thereof progresses, reference being had to the accompanying drawings wherein:

FIG. 1 illustrates an RF system embodying the invention;

FIG. 2 is a transverse sectional view of the system of FIG. 1 taken along line 2-2 of FIG. 1;

DESCRIPTION OF THE PREFERRED EMBODIMENT

Figure 3:
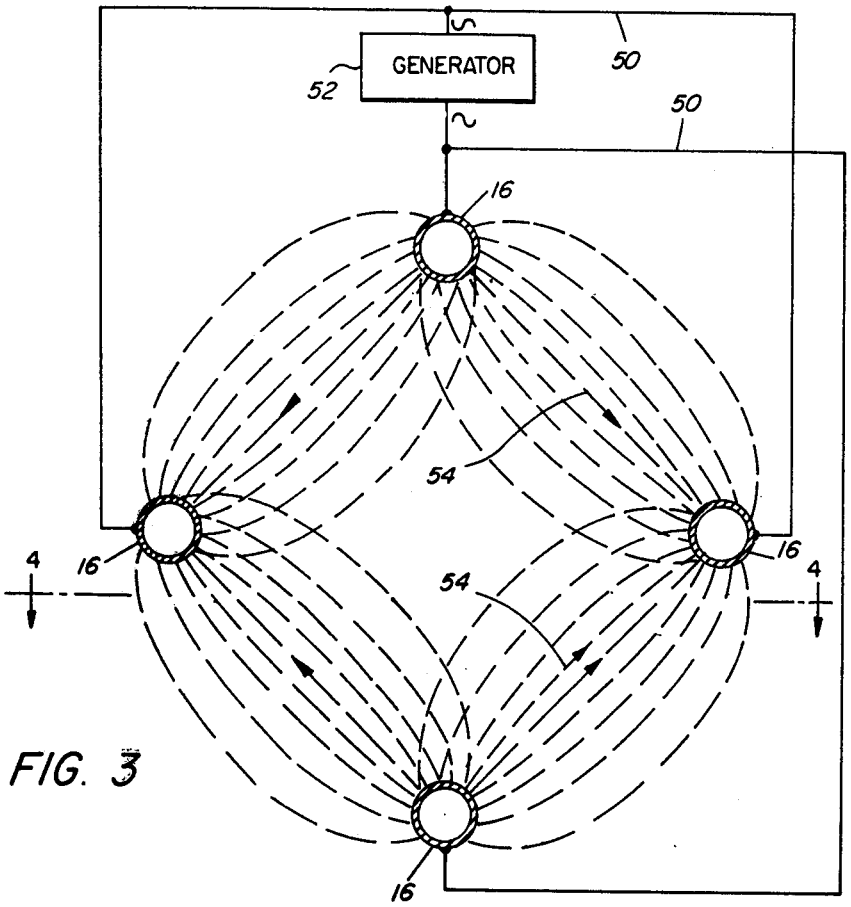
FIG. 3 is a four-electrode embodiment of the invention.

Referring now to FIGS. 1 and 2, there is shown a body of oil shale 10 resting on a substratum 12 and positioned below an overburden 14. Oil shale body 10 may be from several feet to several hundred feet thick and generally comprises layers of material which are rich in kerogens from which organic products may be produced separated by layers of material which are lean in kerogens. Positioned in body 10 and extending through overburden 14 are a plurality of electrode structures 16 which, as as shown here by way of example, are hollow pipes of, for example, eight inches diameter which extend from from the surface to a point approximately midway through the body 10. Pipes 16 have apertures 18 in their lower ends to permit the products of the kerogen produced by heating to flow into the pipes 16 and to collect in sumps 20 beneath pipes 16 from whence they can be removed, for example, by pumps (not shown) on the ends of tubings 22, or formation gas pressure may be generated, if desired, to drive the products to the tops of tubings 22 when the valves 24 thereon are opened.

Pipes 16 are spaced apart by a distance in body 10 which is determined by the characteristics of the oil shale body, and the RF frequency to be used for processing the body. For example, if one megahertz is to be used, a spacing on the order of ten to forty feet is desirable. However, other spacings may be used depending upon the expense of drilling holes through the overburden 14 and into the oil shale body 10 as well as other factors. For other frequencies, the spacing between the pipes 16 may be different, preferably being approximately a tenth of a wavelength in the oil shale. To reduce undesirable radiation of the RF energy, the electrode spacing is preferably less than an eighth of a wavelength so that the pipes 16 may be energized in phase opposition from the RF source to produce the captive electric field between the pipes 16.

RF energy is produced by a generator 30 which supplies energy in phase opposition to impedance and phase adjusting elements 32 which are connected respectively to the pipes 16. The length of the pipes 16 from the point of connection of the impedance and phase adjust sections to their lower ends in body 10 is preferably made greater than a quarter wavelength at the operating frequency of generator 30. For example, if a quarter wavelength in the formation is approximately one hundred feet, the length of the pipes might usefully be between one hundred and one hundred fifty feet long. Under these conditions, pipes 16 are an open-ended parallel wire transmission line having a voltage node at their open ends as shown by the electric fields 34 and having a current node and, hence, low electric fields in the overburden 14.

A screen 36 is preferably positioned on the ground intermediate the pipes 16 and a ground connection from the generator 30 and the phase adjusting and impedance matching elements 32 to reduce the amount of radiation into the atmosphere from radiation escaping from the captive electric field between the pipes 16.

As shown in FIG. 2, the electric field concentrates immediately adjacent the pipes 16 and is reduced with distance away from the pipes 16 having a radial frequency variation which heats the oil shale formation in direct proportion to the square of the field intensity. Since the field intensity is concentrated in both the vertical and the horizontal planes, a maximum concentration is produced at the ends of the pipes 16. Such differential heat produces conditions in which the formation 10 will fracture at relatively low temperatures such as a few hundred degrees which is well below the temperature at which oil shale formation decomposition generally occurs. By applying sufficient energy such as gradients on the order of one to ten thousand volts per inch in such regions, such fracturing can be made to occur in very short periods of time such as a few minutes to a few hours. Furthermore, the positions of such fractures may be varied by pulling the pipes 16 up through the formation to position the ends at different locations.

Preferably, in operation the ends of electrodes 16 will be set at the highest level which it is desired to fracture in the formation 10, and fracturing will proceed. The electrodes will then be driven gradually down through the formation until the lowest level at which fracturing is to be performed has been reached. Preferably, such fracturing leaves unfractured regions for a few feet above the substratum 12 and below the overburden 14 to act as upper and lower caps of the area being fractured.

Follosing fracturing, the formation may be heated, for example, by subjecting the formation to a substantially lower average intensity electric field for a longer period of time to allow the heat to gradually dissipate by thermal conduction into the region between the pipes 16 over a period of hours to months. Following such heating to temperatures which preferably are below the decomposition temperature of the shale formation itself but above the temperature at which the kerogen will produce products which flow into the well bores such as the range of five hundred to a thousand degrees Fahrenheit, the valves 24 will be opened and the liquid collected in the pipes 16 forced to the surface by gas pressure in the formation 10. Substantial quantities of such gas will be produced from the heating, and such gas preferably will be used to drive the liquified products into the sumps 20. At this time, tubings 22 may be lowered into sumps 20 to force the liquids therein to the surface by gas pressure.

If necessary, the formation may be refractured by high intensity electric field to reopen passages in the shale which may gradually close due to overburden pressure or to fracture more deeply into the oil shale body 10, tubings 22 being withdrawn into pipes 16 during this process.

If desired, the interior of the pipes 16 may be pressurized before, during or after the application of RF fracturing energy, for example, by injection pumps 40 through valves 42 so that higher field gradients may be produced between the well electrodes 16 without corona conditions which may produce undesirably high localized temperatures at the surface of the electrodes 16.

Any desired material may be used for the pipes 16 such as steel or steel coated with noncorrosive high temperature alloys such as nickel chrome alloys, and other electrode configurations may be used. However, by the use of a single pipe, the least expense electrode structure from the standpoint of electrode insertion into the oil shale body is achieved, and such electrode structure may also be used to produce the products of the oil shale which are on heating converted to other products such as pipelineable oil.

Referring now to FIG. 3, there is shown a section of a four-electrode structure in which the electrodes 16 are generally of the same type illustrated in FIG. 1. In such a structure, the electrodes are preferably positioned equidistant at the corners of the square, and as shown in the heating mode, energy is supplied as indicated diagrammatically by the wires 50 out of phase from RF generator 52, which includes the impedance matching and phase adjusting structures, to opposite corners of the square so that adjacent electrodes along each side of the square are fed out of phase with RF energy and produce electric fields at a given instance with the arrows 54 as shown. Such a field pattern is substantially more uniform than the field pattern shown in FIG. 2 and, hence, is preferable for RF heating of body 10 since it allows for the oil shale body to become more completely heated in a shorter time period in the regions between the electrodes and below the unfractured portion of the oil shale at the overburden interface.

Figure 4:
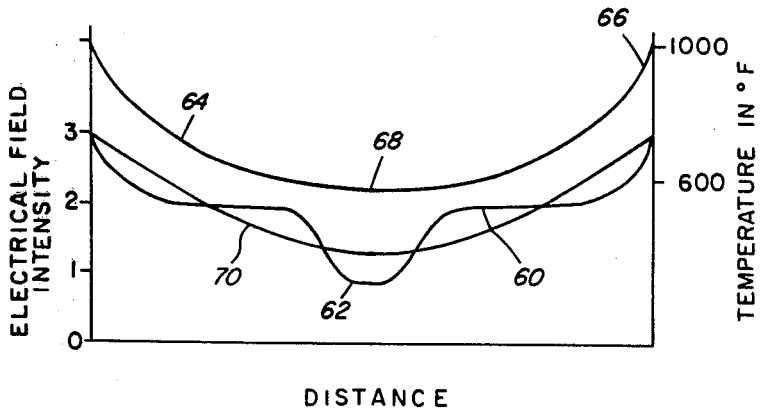
FIG. 4 shows curves of electric field and temperature versus distance for the system of FIG. 3.

Referring now to FIG. 4, there is shown approximate curves of electric field intensity and temperatures for a line taken along 4—4 of FIG. 3. Curve 60 shows electric field intensity to be a maximum adjacent the electrodes 16 and to drop to a value 62, which is less than half the maximum, in the center of the electrode square. Such an electric field will produce heating of the oil shale to produce after a heating time of hours to days a curve of the approximate shape shown at 64 for the temperature gradient along line 4—4, the steepened portions of the heating curve 62 having been smoothed by conductive flow of heat through the formation in the period of hours to days. Further smoothing of the curve which may have peak temperatures of, for example, one thousand degrees Fahrenheit at points 66 and a low temperature of, for example, six hundred degrees Fahrenheit at points 68, constitutes a range at which heating of the kerogen in the oil shale will be sufficient to produce flow of the products of kerogen into the pipes 16.

Curve 70 shows a lower temperature range after production of some of the products of the oil shale, at which time additional RF heating and/or fracturing may be undertaken.

It should be clearly understood that the curves are shown by way of example to illustrate the principles of the invention and will vary in shape due to differences in thermal conductivity and absorption of RF energy by the oil shale formation as well as with the RF power level supplied by the generator and the time which passes during and after the RF heating of the oil shale. As an example, if an oil shale body comprising a cylinder on whose periphery well 16 is positioned having a diameter of fifty feet and a thickness, for example, of fifty feet with a twenty-five foot cap beneath the overburden 16 and a twenty-five foot line above the substratum 12 is to be heated using a voltage at the lower end of electrodes 16 of, for example, 100,000 volts with gradients adjacent the electrodes 16 of around one thousand volts per inch, the formation will act as a load on the ends of the transmission line which may be considered a four-wire transmission line which will absorb on the order of one to ten magawatts of energy from the generator 30 adding over one million BTU's per hour to the formation and raising the average temperature of the oil shale at a rate of one to ten degrees per hour, with the maximum electric intensity regions being raised in temperature at a rate on the order of ten to one hundred degrees per hour so that in less than a day regions adjacent the apertures 18 in the pipes 16 will produce a flow of the products of kerogen into the pipes 16. Under these conditions, it is desirable that RF heating be stopped or reduced when the temperature has reached a predetermined upper limit such as one thousand degrees Fahrenheit at points of maximum heating, for example, adjacent the lower ends of the electrodes 16. This temperature may be sensed by any desired means (not shown) such as by thermocouples or the circulation of fluids in the electrodes 16 past thermometers (not shown). The generator 30 is then either reduced in power or completely turned off, and gas and liquids are removed from the pipes 16 and the sumps 20. During this period which may be, for example, from days to months, the peak temperatures are reduced from the predetermined upper limit which may be chosen in the range from 500° F. to 1000° F. to temperatures of between one-half and three-quarters of the peak temperature. The valves 24 are then shut off and RF energy is again supplied by the generator 30 either in high intensity bursts to refracture the formation in accordance with the patterns of FIG. 2 or in the heating pattern of FIG. 3, or a combination of both, until the peak temperatures are again achieved whereupon the gas and/or fluid is again removed from the pipes 16. If desired, pumps may be positioned inside the pipes 16 rather than in sumps 20 so that they can be operated during the RF heating periods.

Figure 5:
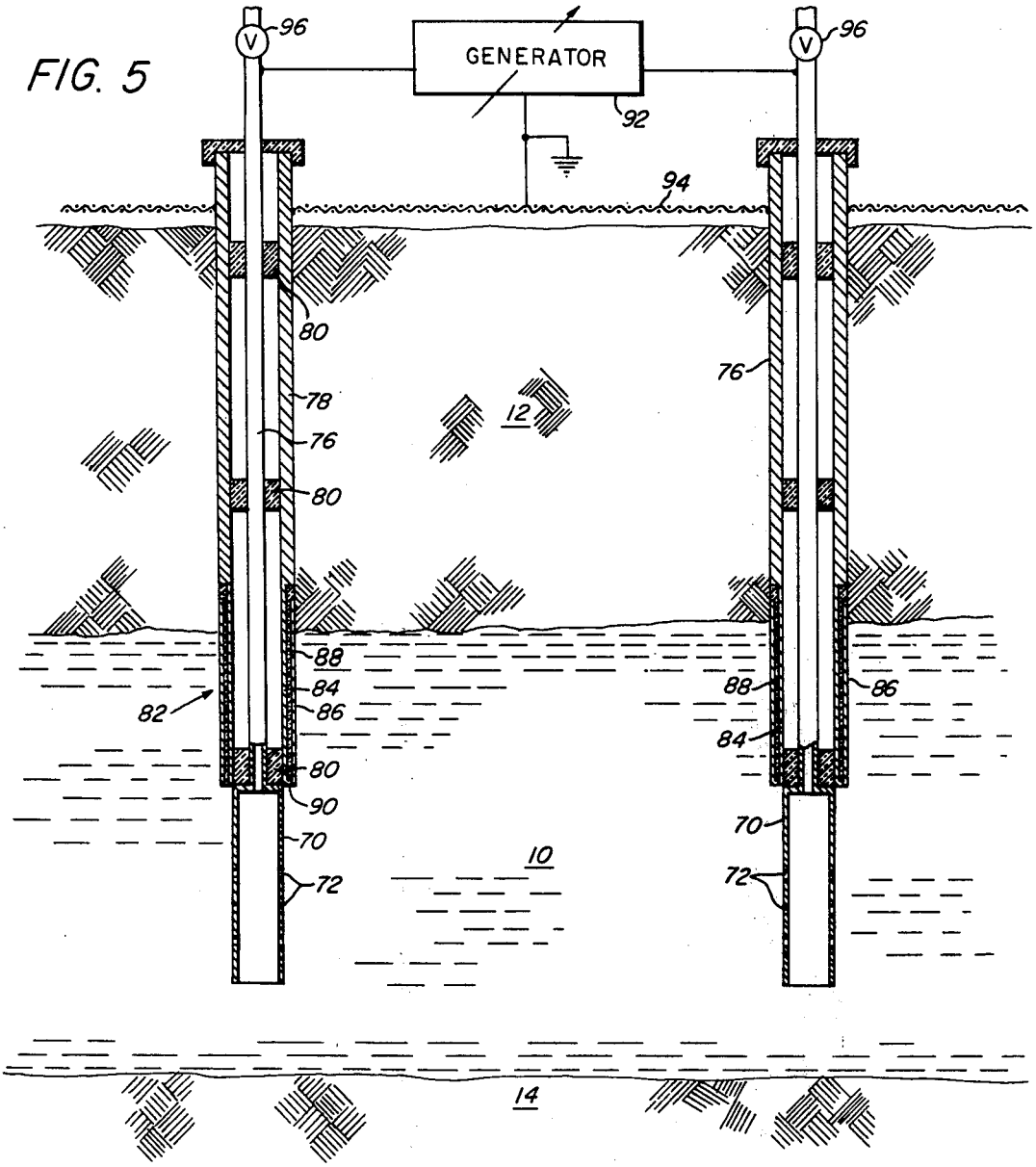
FIG. 5 shows an alternate embodiment of the system of FIG. 1.

Referring now to FIG. 5, there is shown an alternate embodiment of the invention. Oil shale body 10 contains electrodes 70 spaced apart therein, electrodes 70 having apertures 72 adjacent the lower ends thereof through which products derived from kerogen in the oil shale may pass. At the RF frequency, electrodes 70, which may be, for example, six inches in diameter, are preferably one quarter wavelength long in the oil shale and spaced apart by distances on the order of one-half their length or one-eighth wavelength or less in the oil shale. As shown in FIG. 5, the horizontal scale is accentuated to illustrate details of the electrode and feed structure. For example, electrodes 70 at a frequency of one megahertz may be spaced apart by a distance of about forty to fifty feet and the length of electrodes 70 is, for example, about eighty to one hundred feet.

Electrodes 70 are positioned wholly within the shale body 10 and are supported at the ends of producing tubings 76 which extend to the surface of the formation and may be, for example, two-inch steel pipes. Pipes 76 act as the central conductors of coaxial cables in which the outer conductors are casings 78 which may be, for example, eight-inch inside diameter steel piped coated inside, for example, with copper. Conductors 76 are insulated from outer conductors 78 by insulating spacings 80 which are attached to pipes 76 and loosely fit in casings 78.

The lower ends of casings 78 have RF choke structures 82 consisting of relatively thin concentric cylinders 84 and 86 separated by cylinders of dielectric material 88. The upper ends of inner cylinders 84 are connected, as by welding, to the casings 78 and the lower ends of cylinders 84 and 86 are connected together at 90, as by welding, and the upper ends of outer cylinders 80 are insulated from the casings 78 by portions of the dielectric cylinders 80. Structuees 82 are electrically one-fourth wavelength long at the RF frequency and prevent RF energy existing as currents in the inner walls of the outer casings 78 from being conducted to the outer wall of the casings. With such a structure, the length of the casing 78 may be many hundreds of feet, for example, five hundred to a thousand feet long, to extend through thick overburdens 12. In such a structure, energy is fed from a generator 92 of RF energy having a frequency in the range from one hundred kilohertz to one hundred megahertz in phase opposition and suitably impedance matched in generator 92 to pipes 76 to produce a voltage therebetween. Generator 92 has a ground connection to a screen 94 on the surface of the formation which is connected to the outer casings 78 to act as a shield for any stray radiation produced by the electric fields between electrodes 70. The structure of FIG. 5 may be operated in the same fashion as that described in connection with FIGS. 1 through 4 for both fracturing and heating the oil shale formation 10, with production of the products of kerogen in the oil shale being produced by gas pressure in the formation driving both liquid and gas to the surface through tubes 76 where production is controlled by valves 96.

The generator 92 may be variable in frequency to shift the optimum resonant frequency as the dielectric constant of the medium such as the oil shale changes with temperature or upon change in the content of the oil shale by production of the products of kerogen therefrom, and the choke structure 82 will be effective over a 10% to 20% change in generator frequency.

This completes the description of the embodiments of the invention illustrated herein. However, many modifications thereof will be apparent to persons skilled in the art without departing from the spirit and scope of this invention. For example, the heating may be achieved by injection of hot gases through the tubes 76 after the formation has been fractures, and local overheating at the electrodes may be prevented by injecting a cooling medium, such as water, which will produce steam to absorb energy at the peak temperature regions adjacent the electrodes. In addition, the electrode structures need not be vertical and parallel as shown, but any desired electrode orientation such as horizontal electrodes driven into an oil shale formation from a mine shaft formed to the oil shale may be used. Accordingly, it is contemplated that this invention be not limited to the particular details illustrated herein except as defined by the appended claims.

What is claimed is:

1. The method of producing organic products from a body of oil shale beneath an overburden comprising:

producing fracturing in said body by producing an electric field in said body having a frequency in the frequency range between 100 kilohertz and 100 megahertz between a plurality of conductive members extending through said overburden into said body and spaced apart by a distance of less than an eighth of a wave length of said frequency in said body, with regions of said field varying in intensity in mutually orthogonal directions; and supplying additional heat to said body.

2. The method in accordance with claim 1 wherein said fracturing step comprises supplying said field through a transmission line comprising said conductive members and extending from a point outside an overburden on said body and terminating at an open circuit within said body.

3. The method in accordance with claim 1 wherein said step of supplying said field comprises producing RF power at said frequency outside said body and coupling said power to said transmission line comprising said conductive members to produce a standing wave on said transmission line having at least one voltage node within said oil shale body.

4. The method in accordance with claim 3 wherein said step of producing said power comprises coupling a generator of said power to each of a plurality of pairs of adjacent transmission line conductors.

5. The method in accordance with claim 3 wherein said step of producing said power comprises varying the intensity thereof.

6. The method of producing organic products from a body of oil shale comprising:

heating regions of said body comprising producing electric fields having a frequency below 100 megahertz between a plurality of conductive members adjacent to said regions;

said members being spaced apart by a distance which is less than an eighth of a wave length of said frequency in said body; and collecting said organic product through means comprising fissures formed in said body by means comprising said heating.

7. The method in accordance with claim 6 wherein said fracturing step comprises supplying said field with electrodes forming a transmission line extending from a point outside an overburden on said body and terminating at an open circuit within said body.

8. The method in accordance with claim 6 wherein said step of supplying said field comprises producing RF power at said frequency outside said body and coupling said power to a transmission line comprising said conductive members to produce a standing wave on said transmission line having at least one voltage node within said oil shale body.

9. The method in accordance with claim 8 wherein said step of producing said power comprises coupling a generator of said power at said frequency to each of a plurality of pairs of adjacent transmission line conductive members.

10. The method in accordance with claim 8 wherein said step of producing said power comprises varying the intensity thereof.

* * * * *